United States Patent [19]

Müllner et al.

[11] 4,170,076

[45] Oct. 9, 1979

[54] CONTAINER ARRANGEMENT FOR TREATING LUMPY AND GRAINED MATERIALS IN A PACKED BED WITH GASEOUS MEDIA

[75] Inventors: Paul Müllner, Traun; Ernst Wildling, Linz, both of Austria

[73] Assignee: Vereinigte Österreichische Eisen- und Stahlwerke-Alpine Montan Aktiengesellschaft, Linz, Austria

[21] Appl. No.: 850,923

[22] Filed: Nov. 14, 1977

[30] Foreign Application Priority Data

Dec. 1, 1976 [AT] Austria ..... 8880/76

[51] Int. Cl.[2] ..... F26B 17/00

[52] U.S. Cl. ..... 34/217; 34/236

[58] Field of Search ..... 34/225, 236, 216, 217, 34/218; 432/137, 144

[56] References Cited

U.S. PATENT DOCUMENTS

| | | | |
|---|---|---|---|
| 1,445,872 | 2/1923 | Davis | 34/217 X |
| 2,367,487 | 1/1945 | Desetti et al. | 34/225 X |
| 3,214,844 | 11/1965 | Oates et al. | 34/216 X |
| 3,932,946 | 1/1976 | Johnson | 34/236 X |

FOREIGN PATENT DOCUMENTS

| | | | |
|---|---|---|---|
| 823437 | 10/1937 | France | 432/137 |

*Primary Examiner*—Andrew V. Kundrat
*Attorney, Agent, or Firm*—Brumbaugh, Graves, Donohue & Raymond

[57] ABSTRACT

A container arrangement for treating lumpy and grained materials in a packed bed with gaseous media has at least one container with an opening and a device for closing the opening. In the at least one container at least two chambers are formed whose bottom portions communicate with each other. A supply conduit is connected to the top portion of one of the at least two chambers and a drain conduit is connected to the top portion of the respective other one of the at least two chambers so as to form a forced guidance for the gaseous media through the packed bed.

8 Claims, 4 Drawing Figures

CONTAINER ARRANGEMENT FOR TREATING LUMPY AND GRAINED MATERIALS IN A PACKED BED WITH GASEOUS MEDIA

BACKGROUND OF THE INVENTION

The invention relates to a container for treating lumpy or grained materials in a packed bed with gaseous media, wherein an opening of the container can be closed by a lid.

Particulate materials, such as e.g. lime or magnesite, dolomite, are treated for various purposes in various ways, such as being heated, cooled, dried, smouldered, roasted, sintered, burned or reduced. With these methods of treatment, a gaseous medium is guided through the grained material at a certain temperature and possibly under elevated pressure. The types of treatment listed as examples differ from one another in temperature, pressure, heat required or occurrence of heat, respectively, and the duration of treatment.

Numerous devices have been known for the treatment of grained materials with a gaseous medium. Thus, for instance, for treatment at high temperatures (up to approximately 1500° C.), such as roasting, sintering, burning or reducing, shaft furnaces or retortes, revolving cylindrical furnaces, burning plants or a combination of these devices are used. All of these devices, however, have the disadvantage that they are suitable for certain materials or certain kinds of treatment only.

A shaft furnace or a retorte, e.g., is not suited for sintering, since the sintered material cannot be carried out. Also a material which is not sufficiently gas-permeable because of its packing density cannot be treated in these devices. Furthermore, it is difficult to subject the material to be treated to an intermediate treatment, and it is also difficult to control the treatment process.

A revolving cylindrical furnace can be used for a greater number of purposes, yet the cost of investing in such a furnace is very high. A further disadvantage consists in that it is uneconomical as regards its thermal economy. Additionally, process changes in wide ranges can be carried out only over a long period of time.

It has been known to use travelling grates for treating grained materials. Such travelling grates are formed by grate cars joined together to form a continuous chain that continuously travels through a furnace. When the treatment temperatures are high, there is a danger that the grates will become overly deformed or even destroyed, since the treatment gases are also pressed or sucked through the grate. When the treatment temperatures are very high and the periods of treatment are very long at the same time, such as is necessary when calcinating limestone, travelling grates are not suitable. But travelling grates are also not suitable for methods of treatment carried out at low temperatures, for which high pressure differences are necessary (e.g. for the drying of coal), since it is not possible to maintain high pressure differences with these grates.

SUMMARY OF THE INVENTION

The invention aims at providing a container in which lumpy or particulate materials of any desired grain size can be treated even under high temperatures, for long periods of treatment, and with high pressure differences. Furthermore, the containers are to be constructed in a simple manner, without grates and, as far as possible, without any movable parts. The containers are also to have a long useful life. Furthermore, various parameters, such as pressure, temperature, and period of treatment, are to be controllable during the treatment of the material without losing much time.

According to the invention, these objects are achieved in that the container has at least two adjacently arranged chambers whose bottom regions communicate with each other. The materials to be treated lie on and contact the bottom area and the chamber walls in the connecting region of the two chambers to form the packed bed. To the upper part or lid, of one chamber a supply conduit is connected and to the upper part or lid of the other chamber a drain conduit for the gaseous medium is connected, whereby a forced guidance of the gaseous medium through the packed bed is formed.

Preferably, the container has a U-shaped cross-section and a separating wall inserted between the walls, which separating wall ends with its lower edge at a distance above the bottom of the container.

According to an advantageous embodiment, the container can be closed by a single lid covering both chambers, wherein the lid is provided with a seal that contacts the upper edge of the separating wall.

Advantageously, a plurality of containers is arranged one behind the other to form a closed continuous circuit.

Suitably, a plurality of containers are articulately interconnected to form a continuously travelling chain, the chain being guided over vertically arranged deflection wheels.

According to a further advantageous embodiment, a plurality of containers arranged one behind the other are closed by a common lid.

BRIEF DESCRIPTION OF THE DRAWINGS

The invention shall now be described in more detail by way of exemplary embodiments and with reference to the accompanying schematic drawing, wherein.

DESCRIPTION OF EXEMPLARY EMBODIMENTS

Figure 1:
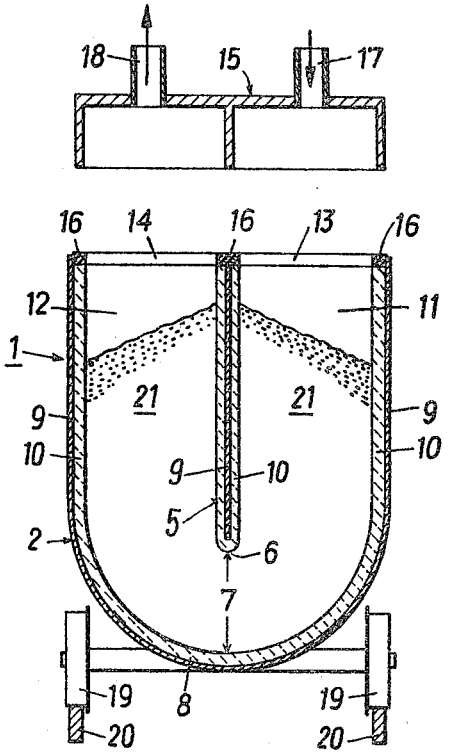
FIG. 1 is a cross-section of the container according to the invention.
Figure 2:
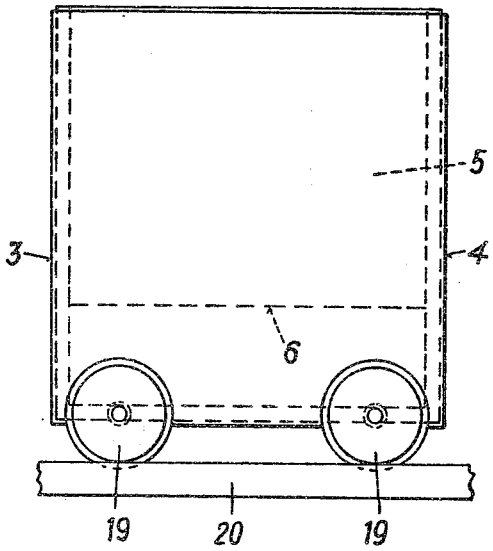
FIG. 2 is a side view thereof.

A container 1 is provided with a U-shaped jacket part 2 which is laterally closed by plane front jacket faces 3 and 4. Within the container 1, parallel to the perpendicular walls of the U-shaped jacket part, a separating wall 5 is arranged, which wall ends with its lower edge 6 at a distance 7 above the arcuate bottom 8 of the container. It extends from one front wall 3 to the opposite front wall 4. Advantageously, the separating wall is detachably secured to the container, e.g. so as to be upwardly removable, whereby it becomes easier to empty the container after treatment of the materials has been carried out. All the walls of the container comprise a supporting wall part 9 of steel and a lining 10 towards the inside of the container.

The separating wall 5 divides the container 1 into two chambers 11 and 12, whose bottom regions communicate with each other. Both chambers 11 and 12 can be filled and emptied via their upper openings 13 and 14, respectively. These openings 13 and 14 can be closed by a lid 15 that covers both chambers 11 and 12. The lid contacts the upper rim of the outer walls 2, 3 and 4 of the container as well as the upper rim of the separating wall 5, via seals 16. The part of the lid 15 which lies above the chamber 11 is provided with a supply conduit 17 and the part which lies above the chamber 12 is provided with a drain conduit 18 for a gaseous medium.

Suitably, the container is movable on wheels 19 along rails 20.

The container functions in the following manner: When the lid 15 is taken off, both chambers 11 and 12 are filled with the material 21 to be treated so that the separating wall 5 becomes immersed in the material. Then the lid 15 is put on the container and the gaseous medium is allowed to enter through the supply conduit 17 and to leave through the drain conduit 18, thus forcing the gaseous medium through the material. Emptying of the container 1 is effected by tilting it when the lid 15 has been taken off. The gaseous medium and the material 21 contact only the lining of the container, and thus the container can be used for treatments involving high temperatures and still have a long useful life.

For filling and emptying the container, closable openings can also be provided on the sides of the container. In this case the supply and drain conduits for the gaseous medium can also be provided in the upper part of a side wall of the container so that a lid that can be taken off. Such a lid is not provided with supply and drain conduits when these conduits are in the side wall.

Figure 3:
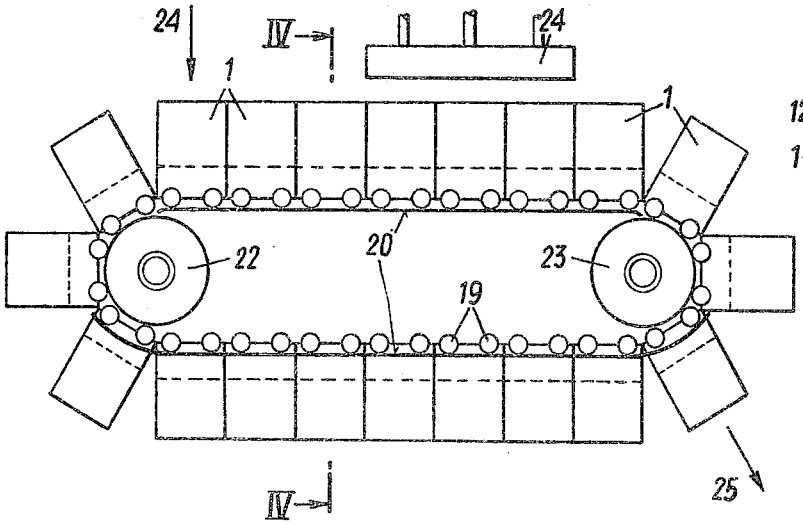
FIG. 3 is a side view of an advantageous embodiment of the invention.
Figure 4:
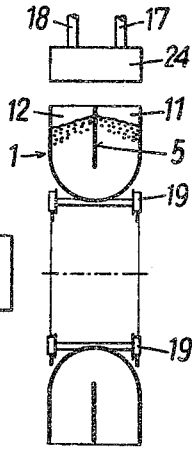
FIG. 4 shows a section along line IV—IV of FIG. 3.

FIG. 3 shows an advantageous arrangement of a plurality of containers as illustrated in FIG. 1 which containers form a continuous chain that is supported via rails 20 and vertically arranged deflection wheels 22 and 23. The containers are articulately connected to each other in such a manner that the separating walls 5 are arranged in the plane of the deflection wheels 22 and 23, whereby the container-chain has a U-shaped cross-section.

Filling of the container, indicated by an arrow 24, is carried out near the deflection wheel 22; emptying of the container, indicated by an arrow 25, occurs automatically after tilting of the containers at the deflection wheel 23.

In the embodiment illustrated in FIG. 3, the lid 24 has a length equal to three containers so that three containers can simultaneously be used for treating the material. When the treatment of the material in the first three containers is finished, they are moved on until the next three containers which have been filled in the meantime arrive underneath the lid.

The invention is not limited to the embodiment illustrated in the description of the Figures, but may be modified in various respects depending on the intended use of the container.

Thus, the container walls can be provided with a means for cooling them. Also, the container can be made without a lining or of a material other than steel. Furthermore, it is possible to guide a container chain forming a closed rotary system over horizontally arranged deflection wheels which are rotatable about a vertical axis.

What we claim is:

1. In a container arrangement for treating lumpy and grained materials in the form of a packed bed with gaseous media and of the type including at least one container having an opening, and closing means provided to close said opening, the improvement which is characterized in that:

at least two adjacently arranged chambers are formed in said at least one container, each one of said at least two chambers having a bottom portion, walls and a top portion, the bottom portion of one of said at least two chambers communicating with the bottom portion of the respective other one of said at least two chambers and the materials to be treated being arranged as a packed bed of material in contact with said bottom portion and said walls of each one of said at least two chambers; and a supply conduit for the gaseous media is connected to the top portion of one of the at least two chambers and a drain conduit for the gaseous media is connected to the top portion of the respective other one of said at least two chambers so as to form a forced guidance for the gaseous media through the packed bed.

2. A container arrangement as set forth in claim 1, wherein the top portion of each one of said at least two chambers is designed as closing means.

3. A container arrangement as set forth in claim 1, wherein said at least one container has a U-shaped cross-section, said at least two chambers being formed by a separating wall inserted in said at least one container and having an upper edge and a lower edge, said separating wall ending with said lower edge at a distance above the bottom portion of each one of said at least two chambers.

4. A container arrangement as set forth in claim 3, wherein said at least one container is closeable by one single closing means covering the at least two chambers, said closing means further including a seal resting on the upper edge of said separating wall.

5. A container arrangement as set forth in claim 1, wherein a plurality of containers are arranged one behind the other so as to form a closed continuous circuit.

6. A container arrangement as set forth in claim 5, further comprising vertically arranged deflection wheels, said plurality of containers being articulately interconnected and guided over said deflection wheels so as to form a continuously travelling chain.

7. A container arrangement as set forth in claim 5, wherein a certain number of said plurality of containers are closed by a common closing means.

8. A container arrangement as set forth in claim 3, wherein said separating wall is capable of being extracted from said at least one container.

* * * * *